US005893289A

United States Patent [19]

Yeomans et al.

[11] Patent Number: 5,893,289

[45] Date of Patent: Apr. 13, 1999

[54] MACHINE HAVING CRIMP HEIGHT COMPENSATION

[75] Inventors: Michael Anthony Yeomans, Camp Hill; David Joseph Erb, Harrisburg, both of Pa.

[73] Assignee: The Whitaker Corporation, Wilmington, Del.

[21] Appl. No.: 08/883,934

[22] Filed: Jun. 27, 1997

[51] Int. Cl.[6] ..... B21D 55/00

[52] U.S. Cl. ..... 72/431; 72/433; 72/434; 72/438

[58] Field of Search ..... 72/431, 433, 434, 72/438, 441

[56] References Cited

U.S. PATENT DOCUMENTS

| | | | |
|---|---|---|---|
| 2,400,412 | 5/1946 | Hawn et al. | 72/431 |
| 2,743,634 | 5/1956 | Badeau | 72/431 |
| 3,417,599 | 12/1968 | Burns | 72/431 |
| 3,791,191 | 2/1974 | Baldyga | 72/431 |
| 4,306,443 | 12/1981 | Matsutani | 73/434 |
| 5,050,284 | 9/1991 | Howard et al. | 72/431 |
| 5,253,508 | 10/1993 | Bakermans | 72/431 |
| 5,551,274 | 9/1996 | Hintz | 72/431 |

FOREIGN PATENT DOCUMENTS 2721338 11/1978 Germany .

*Primary Examiner*—David Jones
*Attorney, Agent, or Firm*—Marshall E. Rosenberg

[57] ABSTRACT

A machine (144) for crimping terminals onto conductors, is disclosed which automatically compensate for different conductor density and terminal sizes for maintaining a desired crimp height for each different combination of sizes. The machine (144) includes a compensating unit (146) that is interposed within the drive mechanism to automatically alter an otherwise fixed distance (162) in the drive mechanism. The compensating unit (146), when combined with the ram, includes a pair of opposed resilient beams (158, 160) that deflect when sufficient axial loading is applied to the ram during the crimping operation. This deflection results in the altering of the fixed distance (162) and, therefore, the altering of the shut height (164) of the machine (144).

5 Claims, 8 Drawing Sheets

MACHINE HAVING CRIMP HEIGHT COMPENSATION

The present invention relates to machines for crimping terminals onto conductors, and more particularly to such machines which automatically compensate for different conductor and terminal sizes for maintaining a desired crimp height for each different combination of sizes.

BACKGROUND OF THE INVENTION

Terminal crimping machines for attaching terminal to magnet wire in the manufacturing of coils for motors and other similar equipment typically have a crimp height adjustment mechanism that is infinitely adjustable. This is used to achieve a particular desired crimp height for each of the large variety of wire number and size combinations that are typical in the industry. For example, any number of different sizes of magnet wires may be terminated in a given terminal, some of these terminations requiring solid wire or stranded wire leads extending therefrom. The adjustments needed to provide the variety of different crimp heights are tedious to make and require the services of a highly skilled operator, and in some cases involving the calculation of the circular mill area (CMA) of the conductors being terminated. In a production environment, where different size conductors and different numbers of conductors are frequently terminated, such adjustments can result in the expenditure of a significant amount of time. These adjustments are usually held to a minimum by arbitrarily selecting ranges of terminal and conductor sizes that will be run for a given crimp height setting. This is, of course, a compromise in that only one particular combination of terminal and conductor in each range will have the correct crimp height setting. Further, in some applications it is often desirable to use the same size and type terminal for all terminations independent of the number and size of the conductors, thereby requiring a relatively large range of adjustment for the varying desired crimp height.

What is needed is a terminal crimping machine having the capability to automatically provide the correct crimp height for each different terminal and conductor combination, independent of variations in the physical size of the terminal or the density of the conductors positioned in the crimping barrel of the terminal.

SUMMARY OF THE INVENTION

A machine is disclosed for performing a crimping operation by crimping a terminal onto a conductor. The machine includes a frame, first crimping tooling coupled to the frame, a ram coupled to the frame and arranged to undergo reciprocating movement along a ram axis toward and away from the first tooling, and second crimping tooling carried by the ram for mating with the first crimping tooling for performing the crimping operation. The first and second tooling will close to a desired shut height when mated. A power unit is attached to the frame and coupled to the ram by means of a drive linkage for effecting the reciprocating movement of the ram and for applying a crimping force to the first and second tooling during the crimping operation. A compensating unit is coupled to the machine and has a resilient portion that deflects upon sensing the crimping force during the crimping operation. This deflection automatically affects the shut height so that the terminal is crimped to a different desired crimp height for each respective different size combination of terminal and conductor.

DESCRIPTION OF THE PREFERRED EMBODIMENT

Figure 1:
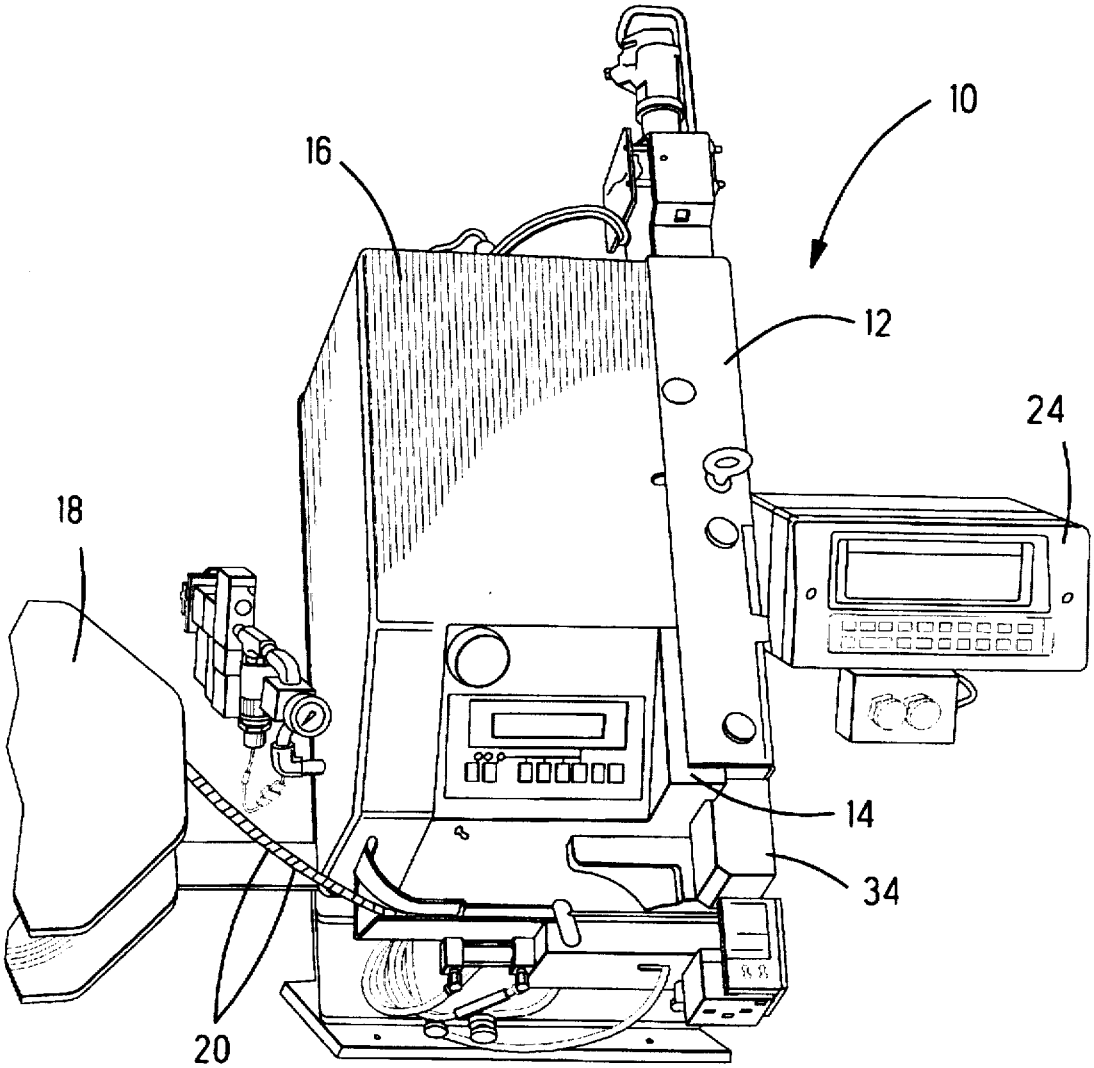
Fig. 1 PRIOR ART
FIG. 1 is an isometric view of a prior art terminal crimping machine.
Figure 2:
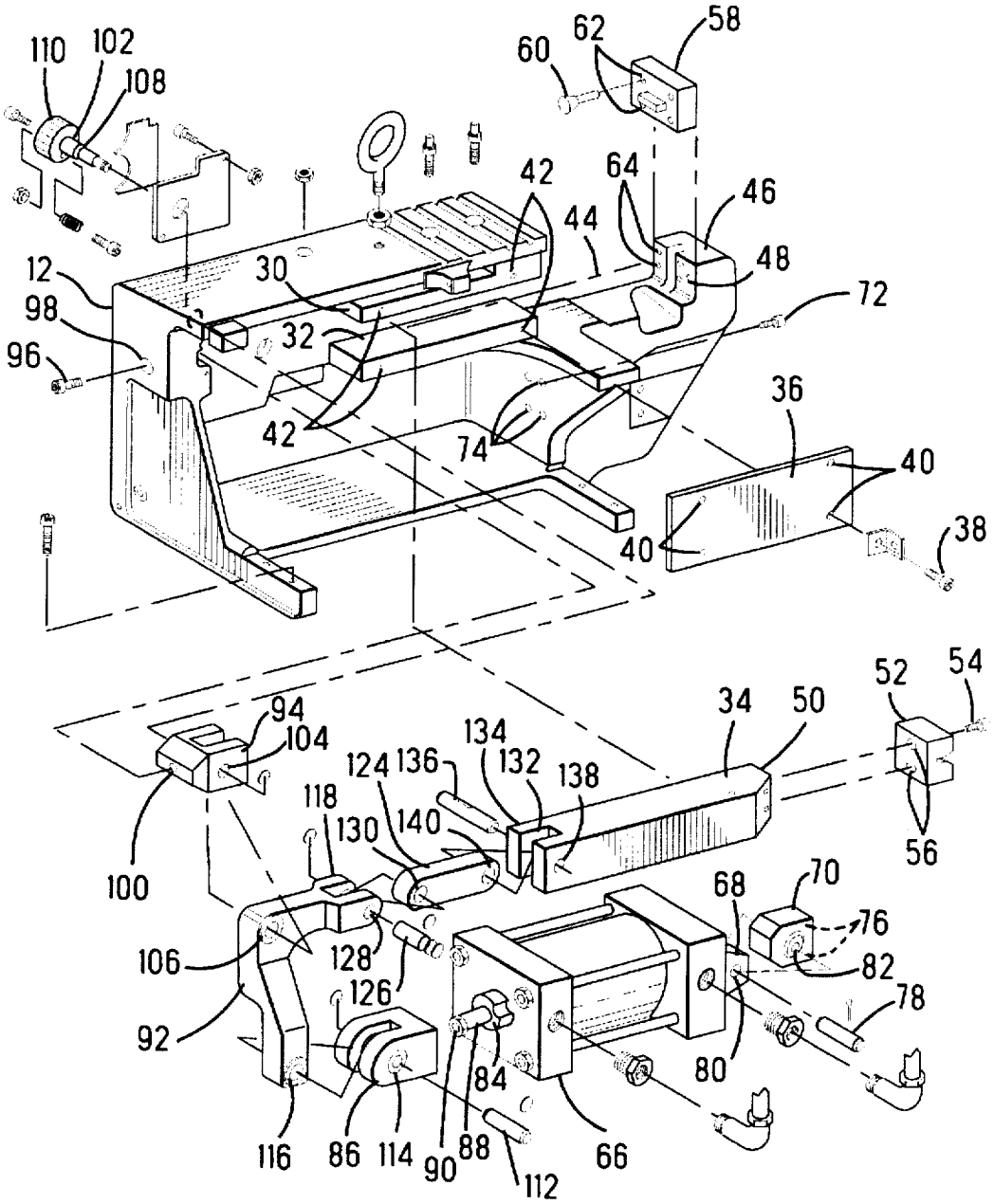
Fig. 2 PRIOR ART
FIG. 2 is an exploded parts view of the machine shown in FIG. 1.

There is shown in FIG. 1 a prior art terminal crimping machine 10 having a frame 12, protective covers 14 and 16 that are removably attached to the frame in the usual manner, and a reel 18 of terminals 20 to be crimped onto conductors. The machine includes a control unit 22 for controlling the operation of the machine as well as a monitor unit 24 for observing the quality of the crimp being produced. The machine 10 is shown in FIG. 2, in exploded parts format, with the covers and the control and monitor units removed for clarity. As best seen in FIG. 2, the frame 12 includes upper and lower flanges 30 and 32 that are spaced apart to slidingly receive a ram 34. A cover plate 36 is secured to the edges of the two flanges 30 and 32 by means of screws 38 that extend through clearance holes 40 in the plate and into threaded holes 42 in the flanges. This forms a box-shaped opening that closely confines the ram 34 and allows the ram to slide freely within the opening along a ram axis 44 toward and away from a base 46 having a mounting surface 48. The end 50 of the ram receives a crimping die 52 which is held in place by means of screws 54 that extend through clearance holes 56 in the crimping die and into threaded holes, not shown, in the end of the ram. A mating crimping punch 58 is attached to the mounting surface 48 by means of screws 60 that extend through clearance holes 62 in the crimping punch and into threaded holes 64 in the end 46. As the ram 34 undergoes reciprocating motion along the ram axis 44, the die and punch tooling 52 and 58 matingly engage to perform the terminal crimping operation in the usual manner.

The ram 34 is driven by an air cylinder 66, which may be any suitable type of linear actuator. The air cylinder has one end pivotally coupled to the frame by means of a pair of flanges 68 that straddle a mounting block 70 that is secured to the frame 12 by means of screws 72 that extend through clearance holes 74 in the frame and into threaded holes 76 in the mounting block 70. A clevis pin 78 extends through holes 80 and 82 formed in the flanges 68 and block 70, respectively. A piston rod 84 extends from the opposite end of the air cylinder 66 and is attached to a clevis block 86 by means of a threaded stud 88 extending from the end of the piston rod and a nut 90. An L-shaped pivot arm 92 is pivotally attached to the frame 12 through another clevis block 94 which is secured to the frame by means of a screw 96 that extends through a hole 98 in the frame and into a threaded hole 100 in the clevis block 94. A pin 102 extends through a hole 104 in the clevis block 94 and a hole 106 in the L-shaped pivot arm 92. The pin 102 includes an eccentric diameter 108 that engages the hole 106 so that when the pin is rotated by a knob 110 that is attached thereto, the pivot arm is caused to move in a direction toward or away from the end 46. This is used to alter the shut height of the machine when adjusting the crimp height. One end of the L-shaped pivot arm 92 is pivotally coupled to the clevis block 86 by means of a pin that extends through a hole 114 in the clevis block and a hole 116 in the end of the pivot arm. The other end of the pivot arm includes a bifurcated portion 118 that receives one end of a drive link 124 and is pivotally coupled thereto by means of a pin 126 that extends through holes 128 in the bifurcated portion and through a hole 130 in the end of the drive link. The other end of the drive link is received in a cutout 132 formed in an end 134 opposite the end 50 of the ram 34, and is pivotally attached thereto by means of a pin 136 that extends through holes 138 formed through the end 134 and a hole 140 in the other end of the drive link 124. With this arrangement, when the piston rod 84 is retracted the pivot arm 92 is pivoted counterclockwise so that the ram 34 is moved in a direction away from the end 46, as viewed in FIG. 2. When the piston rod 84 is extended the ram 34 is moved in the direction toward the end 46 so that the die and punch tooling 52 and 58 matingly engage to perform the crimping operation.

Figure 3:
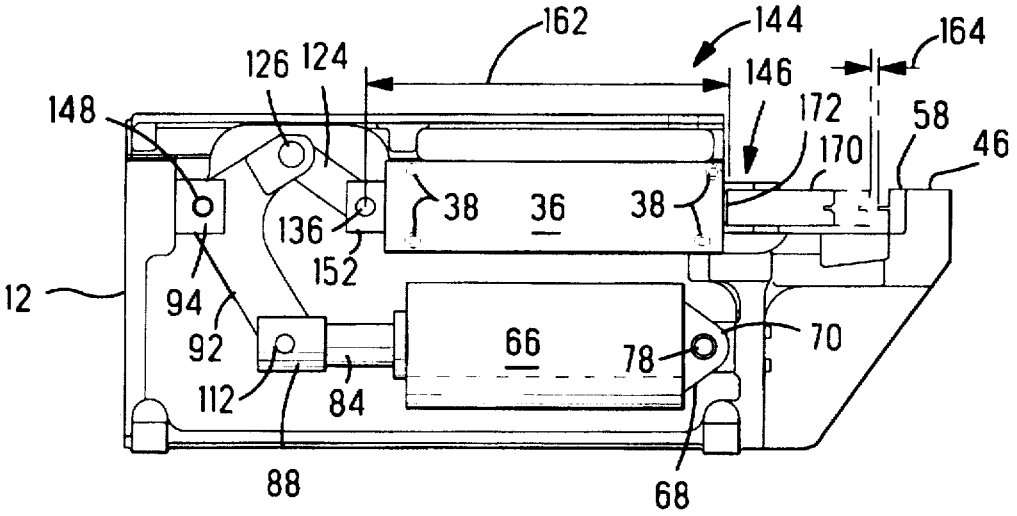
FIG. 3 is a side view of a machine, with the side cover removed, incorporating the teachings of the present invention.
Figure 4:
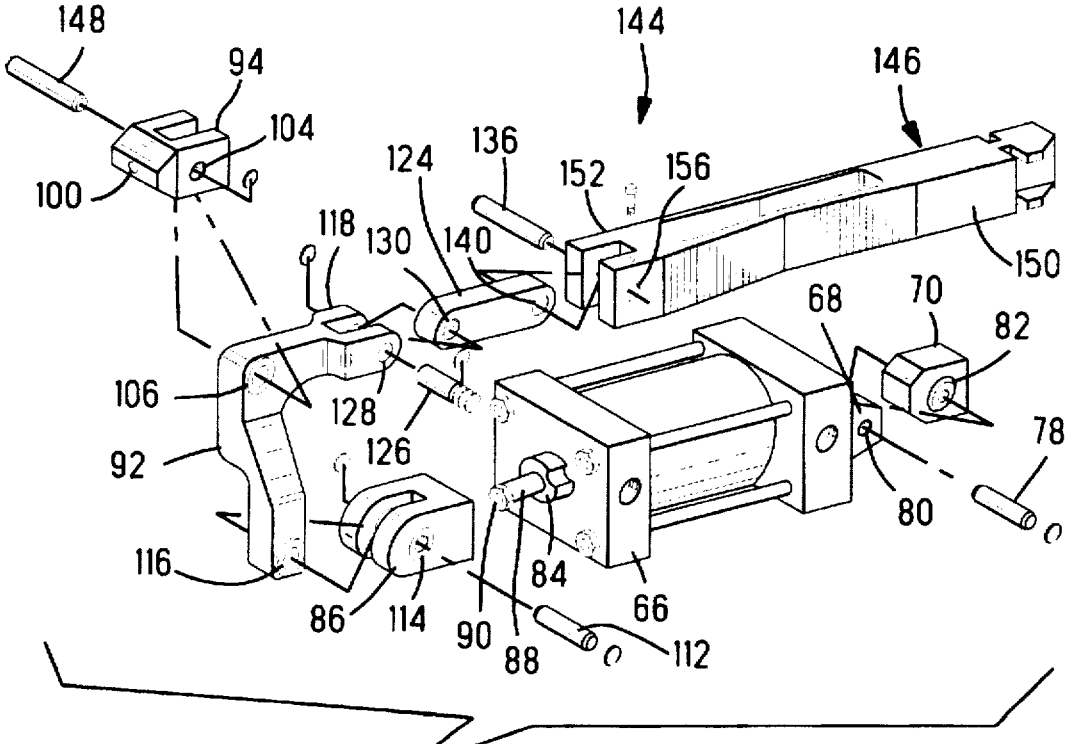
FIG. 4 is an exploded parts view of the power unit and drive linkage of the machine shown in FIG. 3.
Figure 6:
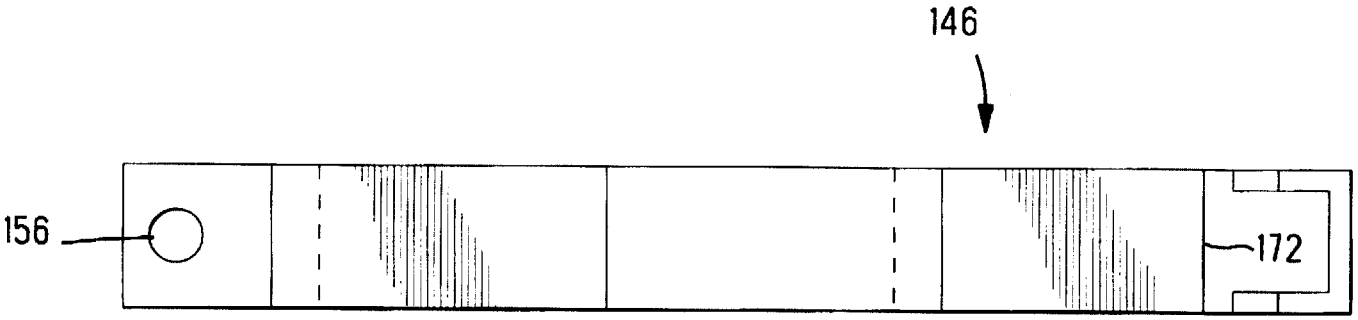
FIGS. 5, 6, and 7 are top, side, and end views, respectively, of the compensating ram shown in FIG. 4.
Figure 5:
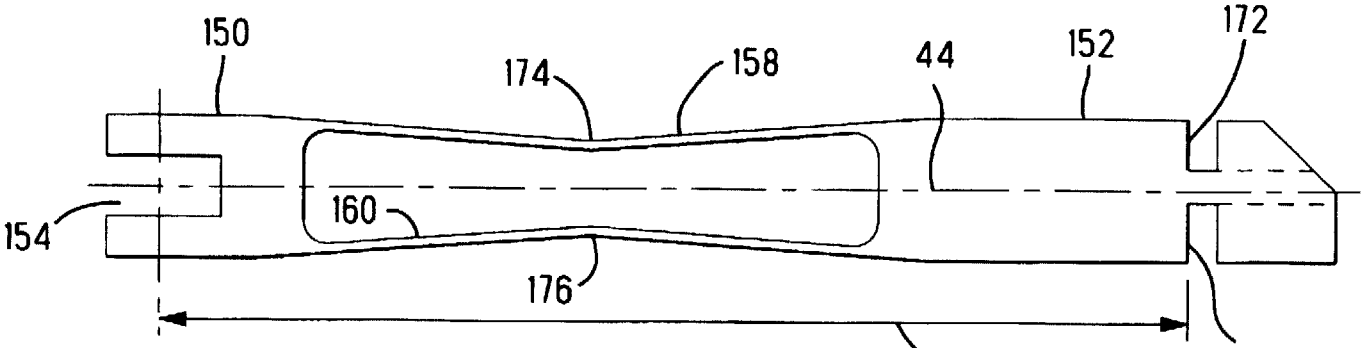
Figure 7:
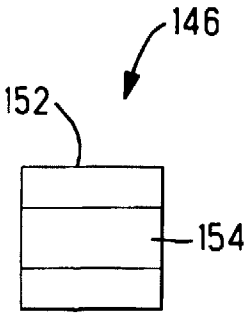

There is shown in FIG. 3 a side view of a machine 144 that is similar to the machine 10 with the side cover 16 removed. The machine 144, having a compensating ram 146, illustrates a first embodiment of the present invention. The machine 144 is substantially similar to the machine 10, having like parts identified by like identifying numbers. However, the machine 144 includes a compensating ram 146 that automatically adjusts the machine shut height during operation of the machine, thereby obviating the need for the manually operated eccentric adjusting pin 102 of the prior art machine 10. FIG. 3 illustrates the operating mechanism of the machine 144 including the air cylinder 66, clevis block 86, L-shaped pivot arm 92, clevis block 94, drive link 124, and compensating ram 146. The L-shaped pivot arm 92 is pivotally coupled to the clevis block 94 by a straight pin 148 extending through the holes 104 and 106 instead of the prior art pin 102 with eccentric diameter 108. Therefore, the L-shaped pivot arm cannot be manually moved toward or away from the end 46 as in the prior art machine. The compensating ram, as best seen in FIGS. 4, 5, 6, and 7, includes first and second ends 150 and 152, respectively, having rectangular cross sections that slidingly engage the opening formed by the upper and lower flanges 30 and 32 of the frame 12 and the cover plate 36. As with the ram 34, the compensating ram 144 is free to slide along the ram axis 44 in the directions toward and away from the end 46 in a manner similar to that of the ram 34. A cutout 154 is formed in the second end 152 and is sized to closely receive the end of the drive link 124. A hole 156 is formed through the end 152 in alignment with the hole 140 of the drive link and the pin 136 extends through the holes to pivotally couple the drive link to the second end of the ram 144. The first and second ends 152 and 154 are joined by a pair of beams 158 and 160 that converge toward the ram axis 44 about mid way between the first and second ends. That is, as the beams 158 and 160 extend from the ends 150 and 152 they converge toward the ram axis. A crimping die 170 is secured to the second end 154 against the mounting surface 172 by screw means, not shown, and aligned to matingly engage the punch 58. The beams 158 and 160 are resilient and will deflect a small amount toward the ram axis 44 when sufficient axial loading is applied to the ram during the crimping operation so that the distance 162 between the pin 136 and the mounting surface 172, as shown in FIG. 3, is lessened, thereby altering the shut height 164, shown in phantom lines, of the machine 144. Each of the beams 158 and 160, as shown in FIG. 5, have relatively straight sections that converge to vertices 174 and 176, respectively. However, the beams may diverge from the ram axis or they may take other forms such as arcuate or helical, as long as the structure of the beams is resilient and will react to axial loading by altering the distance 162 by a predictable amount.

Figure 8:
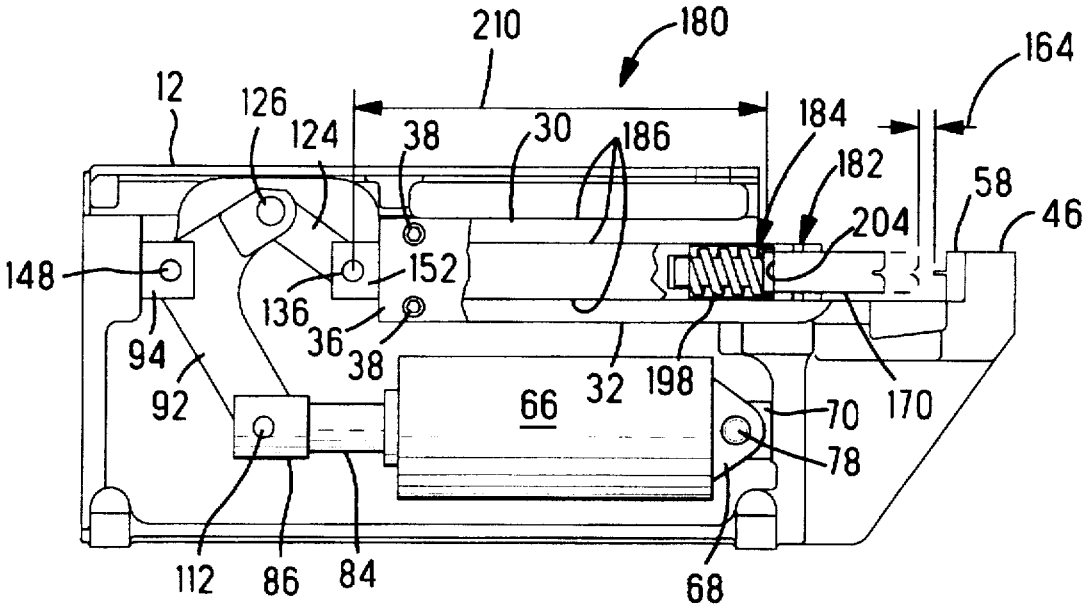
FIG. 8 is a view similar to that of FIG. 3 showing a second embodiment of the present invention.
Figure 9:
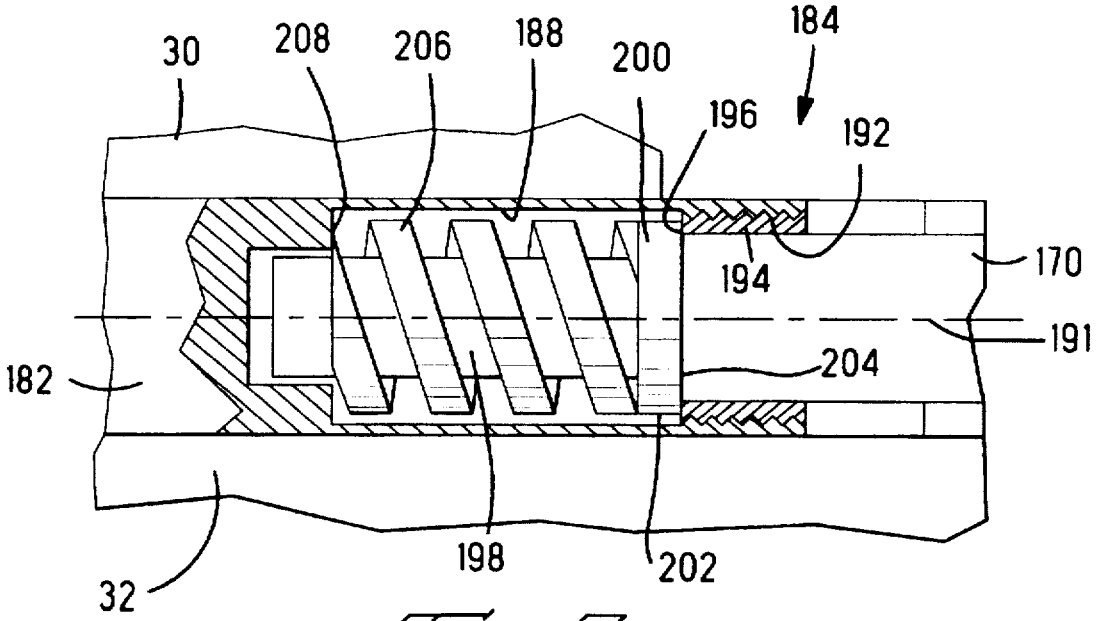
FIG. 9 is an enlarged cross-sectional view of a portion of the machine shown in FIG. 8.

There is shown in FIG. 8 a side view of a machine 180 that is similar to the machine 144 shown in FIG. 3. The machine 180 illustrated in FIG. 8 is a second embodiment of the present invention having a compensating ram 182 that is different from the compensating ram 146. The machine 180 is substantially similar to the machine 144, having like parts identified by like identifying numbers. However, the compensating ram 182 of the machine 180 includes a compensating unit 184. The ram 182 does not have the pair of beams 158 and 160, but rather is a rectangular bar having straight continuous side surfaces. As best seen in FIG. 9, the compensating unit 184 is formed as part of the ram 182 and includes a bore 188 formed in the end of the ram and a smaller concentric bore 190, having an axis 191. The outer end of the bore 188 includes threads 192 for receiving a threaded sleeve 194 having an abutting shoulder 196. A pin 198 is arranged partially in the smaller bore 190 and is a sliding fit therewith. The other end of the pin 198 terminates in an enlarged head 200 having an outside diameter 202 that is a sliding fit with the bore 188 so that the pin 198 is free to slide axially within the bores 188 and 190 a small amount. The enlarged head 202 includes a mounting surface 204 to which the crimping die 170 is secured by means of screws, not shown, in the usual manner. A helical-shaped beam, a relatively heavy helical die spring 206 in the present example, is disposed within the bore 188 around the pin 198. The opposite ends of the die spring abut against the bottom 208 of the bore 188 and the underside of the enlarged head 200, the bottom 208 and the head 200 being two opposite ends of the compensating unit 184 with the spring 206 extending therebetween. The die spring is preloaded so that the mounting surface 204 is urged against the shoulder 196 of the sleeve 194. The amount of preloading and the characteristics of the die spring are chosen so that when sufficient axial load is applied to the mounting surface 204 during the crimping operation, the helical beam or spring 206, being resilient, will compress a small amount. This results in the mounting surface 204 moving a corresponding amount toward the left, as viewed in FIG. 9, so that the distance 210, shown in FIG. 8, between the pin 136 and the mounting surface 204 is lessened, thereby altering the shut height 164, shown in phantom lines, of the machine 180.

Figure 10:
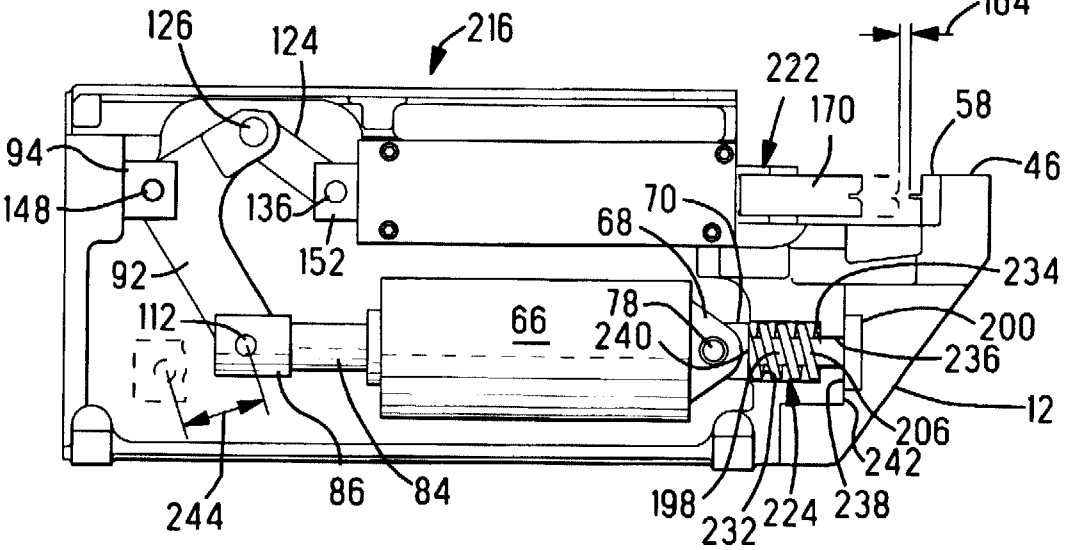
FIGS. 10, 11, and 12 are views similar to that of FIG. 8 showing other embodiments of the present invention.
Figure 11:
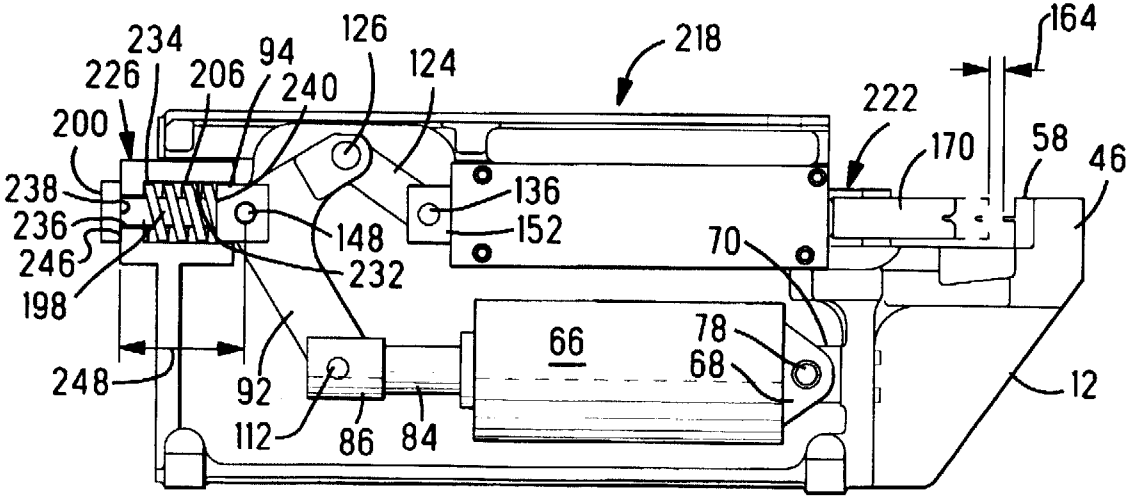
Figure 12:
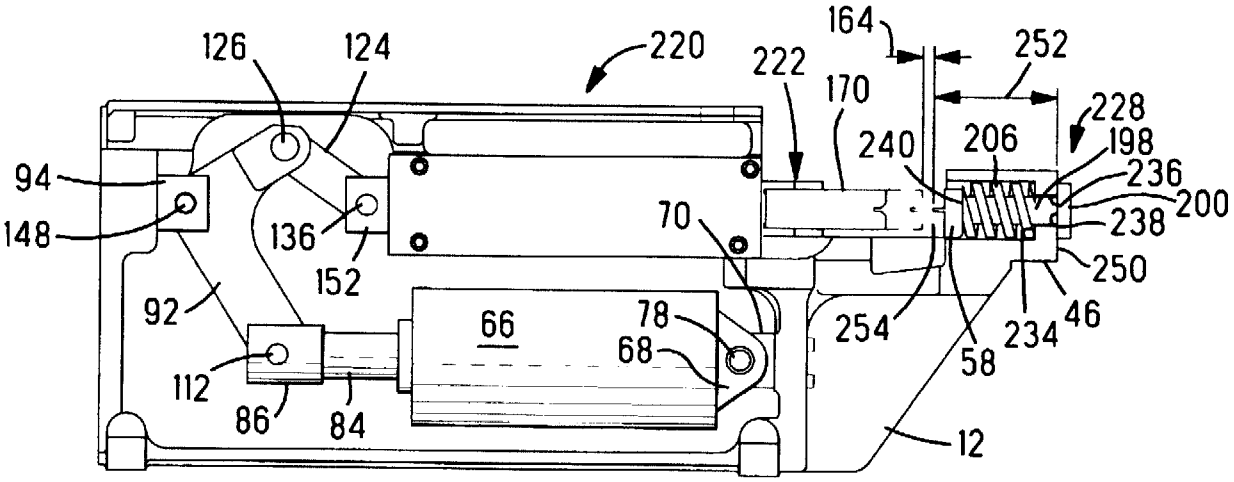

There is shown in FIGS. 10, 11, and 12 a side view of machines 216, 218, and 220 that are similar to the machine 180 shown in FIG. 8. The machines 216, 218, and 220 illustrated in these figures are third, fourth, and fifth embodiments, respectively of the present invention. The machines 216, 218, and 220 are substantially similar to the machine 180, having like parts identified by like identifying numbers, however, the rams 222 of these machines do not include the compensating unit 184, but rather are simply bar-shaped similarly to the prior art ram 34. Each of the machines 216, 218, and 220 do, however, include compensating units 224, 226, and 228, respectively, that are similar to the compensating unit 184, having like parts identified by like identifying numbers, as will be explained. As shown in FIG. 10 the compensating unit 224 is formed as part of the frame 12 and includes a bore 232 formed in the frame and terminating in a shoulder 234, and a smaller concentric bore 236. A pin 198 is arranged partially in the smaller bore 236 and is a sliding fit therewith. The other end of the pin 198 terminates in an enlarged head 200 having an abutting surface 238. The other end of the pin 198 includes a mounting surface 240 that is secured to the mounting block 70 by means of suitable screw fasteners, not shown, in the usual manner. A helical-shaped beam, a relatively heavy helical die spring 206 in the present example, is disposed within the bore 232 around the pin 198. The opposite ends of the die spring abut against the shoulder 234 of the bore 232 and the mounting block 70. The die spring is preloaded so that the surface 238 of the head 200 is urged against an outer surface 242 of the frame 12, and the mounting block 70 and the cylinder 66 are urged toward the left, as viewed in FIG. 10. The amount of preloading and the characteristics of the die spring are chosen so that when sufficient axial load is applied to the mounting block 70 by the crimping operation, the helical beam, or spring 206, which is resilient, will compress a small amount. This results in the cylinder 66 moving a corresponding amount toward the right, as viewed in FIG. 10, so that the distance 244 that the pin 112 moves as the piston rod 84 is fully extended is lessened, thereby altering the shut height 164, shown in phantom lines, of the machine 216.

As shown in FIG. 11 the compensating unit 226 is formed as part of the frame 12 and includes a bore 232 formed in the frame and terminating in a shoulder 234, and a smaller concentric bore 236, in a manner substantially similar to the compensating unit 224. A pin 198 is arranged partially in the smaller bore 236 and is a sliding fit therewith. The mounting surface 240 of the pin is secured to the clevis block 94 by means of suitable screw fasteners, not shown, in the usual manner. A helical die spring 206 is disposed within the bore 232 around the pin 198. The opposite ends of the die spring abut against the shoulder 234 of the bore 232 and the clevis block 94. As with the compensating unit 224, the die spring is preloaded so that the surface 238 of the head 200 is urged against an outer surface 246 of the frame 12, thereby urging the pivot pin 148 toward the right, as viewed in FIG. 11. Again, the amount of preloading and the characteristics of the die spring are chosen so that when sufficient axial load is applied to the clevis block 94 by the crimping operation, the helical beam, or spring 206 will compress a small amount. This results in the clevis block 94 moving a corresponding amount toward the left, as viewed in FIG. 11, so that the distance 248 between the pivot pin 148 and the surface 246 is lessened, thereby altering the shut height 164, shown in phantom lines, of the machine 218.

As shown in FIG. 12 the compensating unit 228 is formed as part of the frame 12 and includes a bore 232 formed in the end 46 of the frame and terminating in a shoulder 234, and a smaller concentric bore 236, in a manner substantially similar to the compensating unit 226. A pin 198 is arranged partially in the smaller bore 236 and is a sliding fit therewith. The mounting surface 240 of the pin is secured to the mating punch 58 by means of suitable screw fasteners, not shown, in the usual manner. A helical die spring 206 is disposed within the bore 232 around the pin 198. The opposite ends of the die spring abut against the shoulder 234 of the bore 232 and the mating punch 58. As with the compensating unit 226, the die spring is preloaded so that the surface 238 of the head 200 is urged against an outer surface 250 of the frame 12, thereby urging the mating punch 58 toward the left, as viewed in FIG. 12. Again, the amount of preloading and the characteristics of the die spring are chosen so that when sufficient axial load is applied to the mating punch 58 by the crimping operation, the helical beam, or spring 206 will compress a small amount. This results in the mating punch 58 moving a corresponding amount toward the right within the bore 232, as viewed in FIG. 11, so that the distance 252 between the outer surface 250 and the mating punch face 254 is lessened, thereby altering the shut height 164, shown in phantom lines, of the machine 220.

Figure 13:
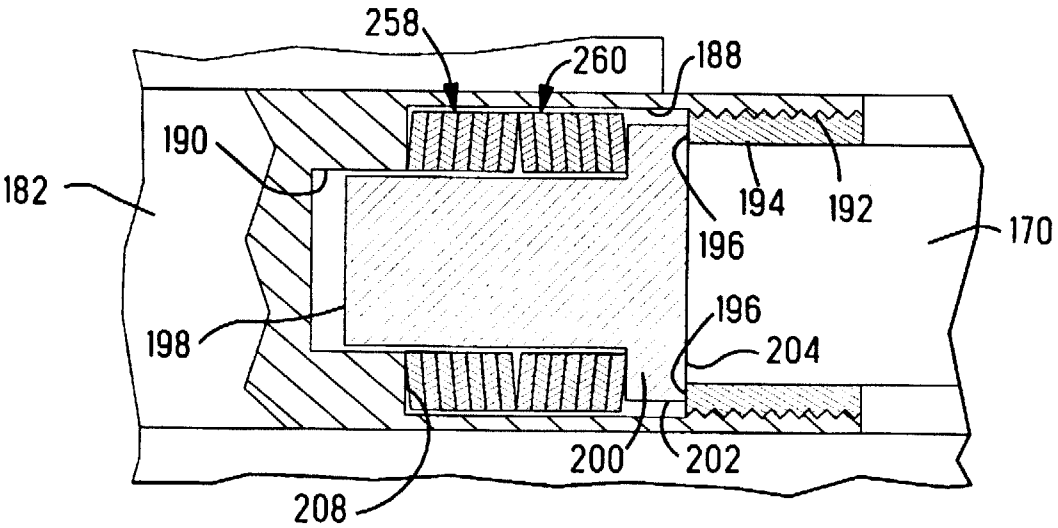
FIG. 13 is a cross-sectional view similar to that of FIG. 9 showing an alternative compensating unit.

It will be appreciated by those skilled in the art that the helical beam 206 shown in the above described several embodiments may take the form of two or more intertwined helical beams or other similar structures, as long as the beam structure is resilient and will react to axial loading by altering the respective distances 162, 210, 244, 248, and 252 by a predictable amount. Similarly, the beam 206 may be replaces in any of these embodiments by another resilient member, for example, by a rubber member or by opposing stacks 258 and 260 of belleville spring washers, as shown in FIG. 13. In this example, the stacks of spring washers are shown within the bore 188, the pin 198 extending through the holes in the spring washers so that the spring washers abut against the shoulder 208 and the underside of the head 202. This urges the head against the shoulder 196 of the sleeve 194 in a manner similar to the spring 206 in the compensating unit 184, as shown in FIG. 9.

Figure 14:
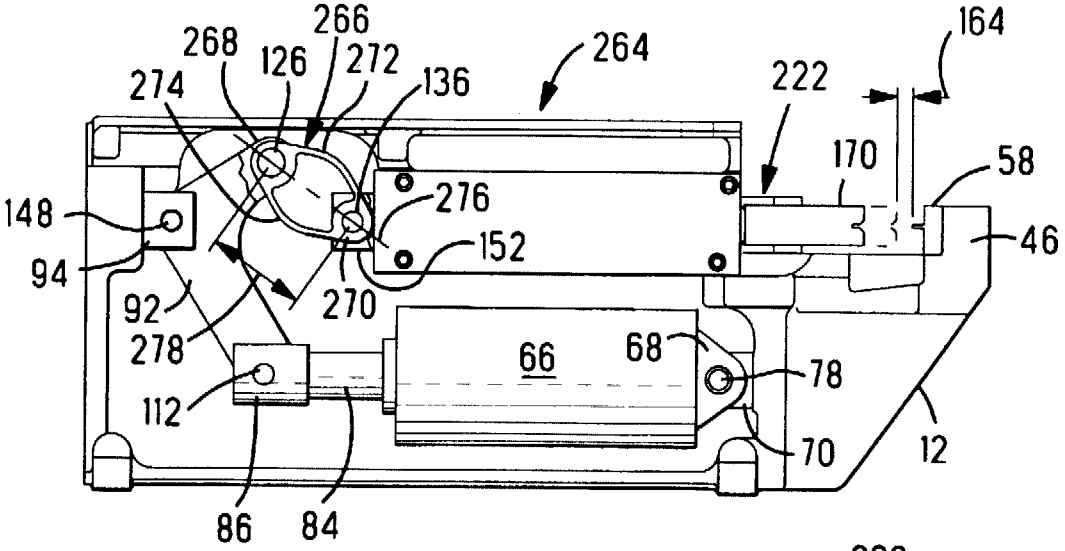
FIG. 14 is a view similar to that of FIG. 8 showing another embodiment of the present invention.

There is shown in FIG. 14 a side view of a machine 264 that is similar to the machine 180 shown in FIG. 8. The machines 264 illustrated in FIG. 14 is a sixth embodiment of the present invention. The machine 264 is substantially similar to the machine 180, having like parts identified by like identifying numbers, however, the machine 264 includes the ram 222 without the compensating unit 184. The machine 264 does include a compensating unit 266 that replaces the drive link 124 of the machine 180. The compensating unit 266 includes first and second ends 268 and 270, respectively, that are pivotally attached to the L-shaped pivot arm 92 and the second end 152 of the ram 222, by means of the pins 126 and 136, respectively. The first and second ends 268 and 270 are interconnected by a pair of resilient beams 272 and 274, each of which are bowed away from the longitudinal axis 276 of the unit 266. Alternatively, the pair of beams 272 and 274 may be bowed inwardly toward the axis 276. The purpose of the bowing is to allow the resilient beams to deflect slightly when a sufficient axial load is applied to the second end 152 and the L-shaped pivot arm 92 by the crimping operation. This results in the first and second ends 268 and 270 moving together a corresponding amount so that the distance 278 between the pins 126 and 136 is lessened, thereby altering the shut height 164, shown in phantom lines, of the machine 264.

Figure 15:
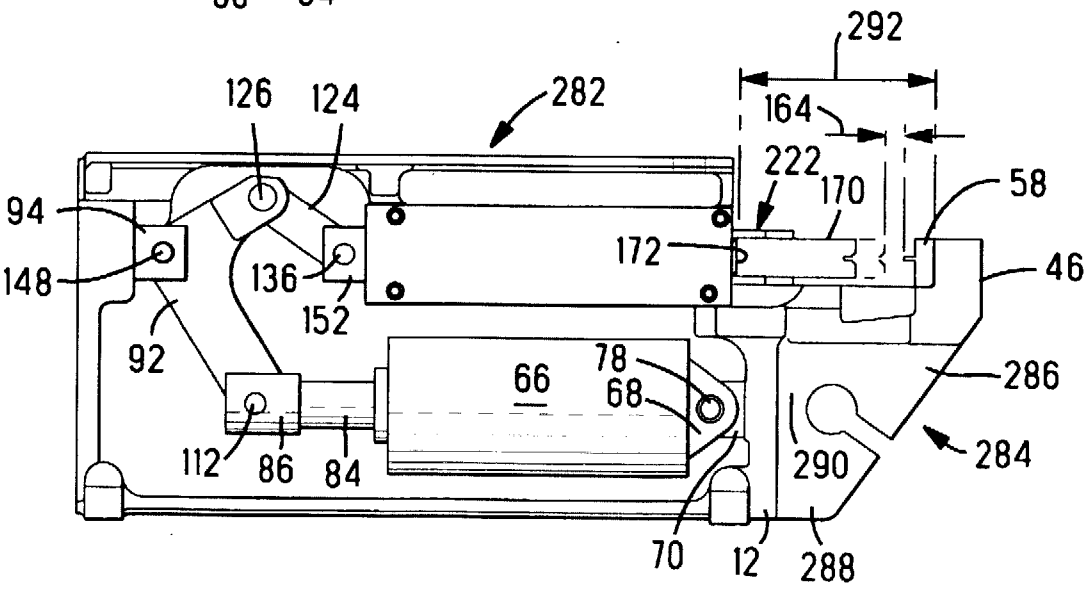
FIG. 15 is a view similar to that of FIG. 14 showing another embodiment of the present invention.

There is shown in FIG. 15 a side view of a machine 282 that is similar to the machine 264 shown in FIG. 14, and illustrates a seventh embodiment of the present invention. The machine 282 is substantially similar to the machine 264, having like parts identified by like identifying numbers, however, the machine 282 includes the drive link 124 instead of the compensating unit 266. The machine 282 does include a compensating unit 284 that is integral to the frame 12 of the machine 282. The compensating unit 284 includes first and second ends 286 and 288, respectively, that are interconnected by a resilient beam 290 extending between the first and second ends. The first and second ends 286 and 288 and the beam 290 form a gusset that supports the base 46 with respect to the main portion of the frame 12. The purpose of the beam 290 is to deflect slightly when a sufficient axial load is applied to the base 46 and the mounting block 70 by the crimping operation. This results in the base 46 moving away from the advancing ram 222 a corresponding amount so that the distance 292 between the mounting surface 172 of the ram and the base 46 is lengthened, thereby altering the shut height 164 of the machine, shown in phantom lines. It will be understood that the structure of the compensating unit 284, as shown in FIG. 15, is by way of example only and that other similar compensating units may be formed integral to the frame 12 or other parts of the machine 282 that will function in a similar manner.

While there are several embodiments of the present invention described herein, they all operate to alter an otherwise fixed distance in the drive mechanism of the machines. A compensating unit for altering this distance can be included anywhere within this drive mechanism from the mounting of the mounting block 70 to the frame 12, through the cylinder 66 and L-shaped pivot arm 92 to the clevis block 94, through the link 124, through the ram 222, to the mating punch 58 and its mount to the base 46.

An important advantage of the present invention is that a variety of different numbers and sizes of conductors may be terminated in a given terminal without first adjusting the shut height of the machine to achieve a desired crimp height. This results in increased productivity of the machine and may be operated by a relatively unskilled operator.

We claim:

1. In a machine for performing a crimping operation by crimping a terminal onto a conductor wherein said machine includes a frame, first crimping tooling coupled to said frame, a ram coupled to said frame and arranged to undergo reciprocating movement along a ram axis toward and away from said first tooling, second crimping tooling carried by said ram for mating with said first crimping tooling for performing said crimping operation, said first and second tooling having a shut height when mated, and a power unit coupled to said frame and said ram by means of a drive linkage for effecting said reciprocating movement of said ram and applying a crimping force to said first and second tooling during said crimping operation, said ram comprising:

first and second spaced apart ram ends having a longitudinal axis extending therethrough, and a pair of spaced apart beams on opposite sides of said longitudinal axis extending between said first and second ram ends arranged so that upon said deflection of said pair of beams said first and second ram ends move along said longitudinal axis toward each other, for automatically affecting said shut height during said crimping operation so that said terminal is crimped to a desired crimp height for each respective combination of terminal and conductor.

2. The machine according to claim 1 wherein said pair of beams converge toward said longitudinal axis from both said first ram end and said second ram end.

3. The machine according to claim 2 wherein upon said deflection of said pair of beams, each said beam deflects toward said longitudinal axis.

4. The machine according to claim 1 wherein each said beam of said pair of beams has one end rigidly attached to said first ram end and an opposite end rigidly attached to said second ram end.

5. The machine according to claim 4 wherein said second crimping tooling is attached to said first ram end and said second ram end is pivotally attached to a drive link of said drive linkage.

* * * * *